US005873319A

United States Patent [19]

Bentley

[11] Patent Number: 5,873,319

[45] Date of Patent: Feb. 23, 1999

[54] LOCKING DEVICE FOR A WATERCRAFT MOORING DEVICE AND METHODS OF MAKING THE SAME

[76] Inventor: Darrell G. Bentley, P.O. Box 609, Licking, Mo. 65542

[21] Appl. No.: 891,768

[22] Filed: Jul. 14, 1997

[51] Int. Cl.[6] ..... B63B 21/00

[52] U.S. Cl. ..... 114/230; 114/218; 410/104; 70/18

[58] Field of Search ..... 114/230, 218; 410/104, 105, 109, 112, 113; 70/18

[56] References Cited

U.S. PATENT DOCUMENTS

| | | | |
|---|---|---|---|
| 4,297,963 | 11/1981 | Beacom | 114/230 |
| 4,418,550 | 12/1983 | Hamilton | 70/18 |
| 4,873,848 | 10/1989 | Honeyman, III | 70/14 |
| 5,184,488 | 2/1993 | Sandlin | 70/14 |
| 5,467,617 | 11/1995 | Huebner | 70/18 |

*Primary Examiner*—Jesus D. Sotelo

*Attorney, Agent, or Firm*—Richard L. Marsh

[57] ABSTRACT

A mooring device for securing of watercraft to a structure having spaced apart planking is provided. The mooring device comprises a shaft, an elongated head mounted transverse to the shaft on one end, a T-shaped handle removably mounted on the other end, a clevis, an enlarged plate disposed on the shaft and a biasing spring encircling the shaft adapted to bias the plate toward the bar. The mooring device has a locking bar associated therewith which is substantially a planar elongated bar having a wedge shaped offset portion on one end, a T-shaped handle support on the other end and a shaft support intermediate the ends. The offset portion is adapted to be disposed between the planking with a knee of the bar bearing against the top surface of the plate. The locking bar is rotated in the plane of the bar until the offset portion bears against the underside of the plate, the shaft support on the back of the body bears against the shaft and the handle support underlies the T-shaped handle. A padlock is then inserted through the shackle and the lock hole in the bar securing the locking bar to the mooring device thereby securing the mooring device to the structure.

20 Claims, 4 Drawing Sheets

LOCKING DEVICE FOR A WATERCRAFT MOORING DEVICE AND METHODS OF MAKING THE SAME

CROSS REFERENCE TO RELATED APPLICATIONS

This application is a continuation-in-part application of its parent patent application Ser. No. 08/723,383 filed Sep. 30, 1996 which is a continuation-in-part application of its parent patent application Ser. No. 08/544,972 filed Mar. 3, 1996, now abandoned.

BACKGROUND OF THE INVENTION

1. Field of the Invention

This invention relates to a locking device for a mooring device adapted for removably mooring a watercraft to a dock. The mooring device is a spring-loaded fastener requiring only a quarter turn to move from a fastening position to a release position and utilizes a locking bar engaged with elements of the mooring device to lockably secure watercraft to a docking platform.

2. Prior Art Statement

When a watercraft owner desires to moor a watercraft to a dock, it is customary to secure a lanyard to a cleat on both the dock and the boat by lacing the opposite ends of the lanyard around the respective cleats in a figure eight fashion. Such a mooring is temporary in nature and does not prevent theft of the watercraft as it is easy to remove the lanyard from either the dock or the boat. For a more secure docking of a watercraft, the craft may be raised from the water on a boat lift but such docking is cumbersome and generally available only at the home location of the boat or a marina equipped with boat lifts. Therefore, a mooring device adapted for mooring and locking a watercraft to a dock is desired wherein the mooring device has a spring-loaded fastener requiring only a quarter turn to move from a fastening position to a release position and a separate locking means which engages elements of the mooring device for lockably securing a watercraft to any mooring structure having spaced apart decking or planking.

It is known to utilize a mooring device for temporarily mooring a watercraft to a dock having spaced apart dock planks wherein the mooring device has a rigid T-bar form body with an elongated head secured transversely to one end of a shaft, a flat plate mounted on the shaft with a biasing means associated therewith to bias the plate toward the shaft. For instance, see the U.S. Pat. No. 4,297,963 issued on Nov. 3, 1981 to Keith Beacom.

It is further known to provide a device for securing valuables such as a boat wherein the device has a U-shaped hasp with an eye at one end of one of the legs for attaching chains, cables or the like with both legs of the hasp having a slot therethrough for receiving a latch lug pivoted to one of the legs. For instance, see U.S. Pat. No. 4,873,848 issued on Oct. 17, 1989 to Henry Honeyman, III.

It is also known to provide a locking system for a boat having a centerboard slot where a locking member having an elongated portion projecting through the slot and extending beyond the ends of the slot with at least one end having at least one dimension greater than at least one dimension of the slot wherein the locking member has means for securing a cable, chain or rope with a padlock therein. For instance, see U.S. Pat. No. 4,418,550 issued to James Hamilton on Dec. 6, 1983 or U.S. Pat. No. 5,467,617 issued on Nov. 21, 1995 to Jerold R. Huebner.

Furthermore, it is known to provide an anti-theft device for a trailer and boat having an outdrive with a propeller with a plurality of blades, the anti-theft device having a yoke with side portions extending around opposite sides of the outdrive, a propeller locking arm engaging the rear annular surface of the propeller and extending into the hollowed area of the hub and a lock means for securing the anti-theft device to a fixed object. For instance, see U.S. Pat. No. 5,184,488 issued on Feb. 9, 1994 to William H. Sandlin.

Finally, it is well known to provide an eye in each of two elements for securing the elements together with a padlock such as is used in a common door or trunk hasp.

SUMMARY OF THE INVENTION

The above mentioned means of mooring watercraft to docks either do not have a means to lockably secure the mooring device to the dock or need to utilize a post or a cleat or an eye fixed to the dock. Therefore, it is essential to provide a locking means associated with a mooring device and more particularly a snubber disposed between a plate and a T-handle of the mooring device wherein the snubber has means for securing to a clevis on the mooring device thereby preventing removal of the mooring device from the mooring platform.

It is an object of this invention to provide a mooring device adapted for lockably attaching a watercraft to a docking platform.

It is another object of this invention to provide a mooring device having a locking means associated therewith, the mooring device comprising an upright pivot shaft having a T-shaped handle at one end thereof, an elongate head at the other end thereof, a biasing spring, clevis and tension plate intermediate the ends, the elongated head being rigidly affixed to the end of the pivot shaft, the tension plate being biased toward the elongated head by the biasing spring and the locking means comprising a snubber disposed between the plate and the T-handle, the snubber having means for securing to the clevis thereby preventing removal of the mooring device from the mooring platform.

It is yet another object of this invention to provide a locking means for a mooring device having securing means which projects from an upper end of a snubber parallel to and substantially the same size as the clevis and has a padlock means for receiving a padlock therein, the securing means being disposed between a T-handle support and a shaft support of the snubber capturing the clevis therebetween when a padlock is inserted in the padlock means.

It is still another object of this invention to provide a locking means for a mooring device wherein a snubber has a handle engaging means on the upper end thereof for engaging the handle and preventing rotation thereof It is another object of this invention to provide a locking means for a mooring device wherein a snubber has a plate engaging means on the lower end thereof for engaging the plate on the upper surface thereof, the plate engaging means preventing rotation of the snubber relative to the plate.

It is another object of this invention to provide a locking means for a mooring device wherein a plate engaging means of a snubber has a horizontal portion extending beyond an edge of the plate.

It is another object of this invention to provide a locking means for a mooring device wherein a horizontal portion of a snubber extends beyond the edge of the plate and has a vertical portion at the terminal end thereof engaging the edge of the plate.

It is another object of this invention to provide a locking means for a mooring device wherein a vertical portion of a snubber extends downwardly between the decking elements below the plate thereby preventing rotation of the snubber relative to the docking platform.

It is yet another object of this invention to provide a locking means for a mooring device wherein a vertical portion of a snubber extending downwardly between the decking elements below the plate has a wedge shaped portion protruding under the plate and engages the bottom surface of the plate at least at the juncture of the bottom surface and the edge of the plate.

Additionally, it is an object of this invention to provide a locking means for a mooring device having a wedge shaped portion of a snubber offset relative to the plane of a vertical portion of the snubber.

Furthermore, it is an object of this invention to provide a locking means for a mooring device having a snubber, a means for securing, a plate engaging means, a horizontal portion, a vertical portion and a wedge shaped portion disposed in one plane wherein the means for securing projects from one edge of the plane of the snubber and the horizontal portion, the vertical portion and the wedge shaped portion extend from an edge opposite the one edge.

Another object of this invention to provide a locking means for a mooring device wherein a snubber has a support extending at a right angle therefrom intermediate the plate and the T-handle of the mooring device, wherein the snubber and the support are parallel to and adjacent to the shaft of the mooring device when engaged therewith and secured to a clevis on the shaft of the mooring device.

It is still another object of this invention to provide a locking means for a mooring device wherein a snubber has an L shaped handle engaging means on the upper end thereof which engages the handle on the underside and against at least one face.

It is still another object of this invention to provide a locking means for a mooring device wherein a snubber has an upright L-shaped handle engaging means disposed at a right angle to the plane of the snubber.

Other objects of this invention include providing a locking means for a mooring device wherein a snubber has a channel shaped handle engaging means on the upper end thereof which engages the handle on the underside and against at least one face and overlies the upper surface of the handle and a channel shaped shaft engaging means disposed on the snubber intermediate the plate and the T-handle of the mooring device, wherein the snubber and the channel shaped support are parallel to and adjacent to the shaft of the mooring device capturing the shaft in said channel.

It is still another object of this invention to provide a locking means for a mooring device wherein a snubber has an channel shaped handle engaging means disposed at a right angle to the plane of the snubber.

Yet another object of this invention to provide a locking means for a mooring device wherein a handle engaging means of the a snubber extends on either side of the snubber and supports the handle for the full length thereof.

An additional object of this invention is to provide a locking means for a mooring device wherein an L-shaped handle engaging means of a snubber has a central portion removed from the horizontal leg thereof for capture of the jam nut of the mooring device therein.

In still another object of this invention a locking means for a mooring device is provided wherein a wedge shaped portion of a vertical portion of a snubber extending downwardly between the decking elements below the plate also extends below a bottom surface of the decking elements preventing rotation of the T-shaped locking bar into the slot between the decking elements.

Finally, it is an object of this invention to provide a method of making a locking device for a mooring device comprising the steps of forming a snubber in a crank shape from a flat plate of metal, the snubber having a having an offset portion formed on one end thereof, a handle engaging means formed on the other end thereof and a shaft support formed at a right angle to the snubber intermediate the handle engaging means and the offset portion.

DESCRIPTION OF THE PREFERRED EMBODIMENTS

While the various features of this invention are hereinafter described and illustrated as a device to moor a watercraft to a dock, and particularly, to lockably secure a watercraft to a dock, it is to be understood that the various features of this invention can be used singly or in various combinations thereof to provide for mooring of other objects to other locations as can hereinafter be appreciated from a reading of the following description.

Figure 1:
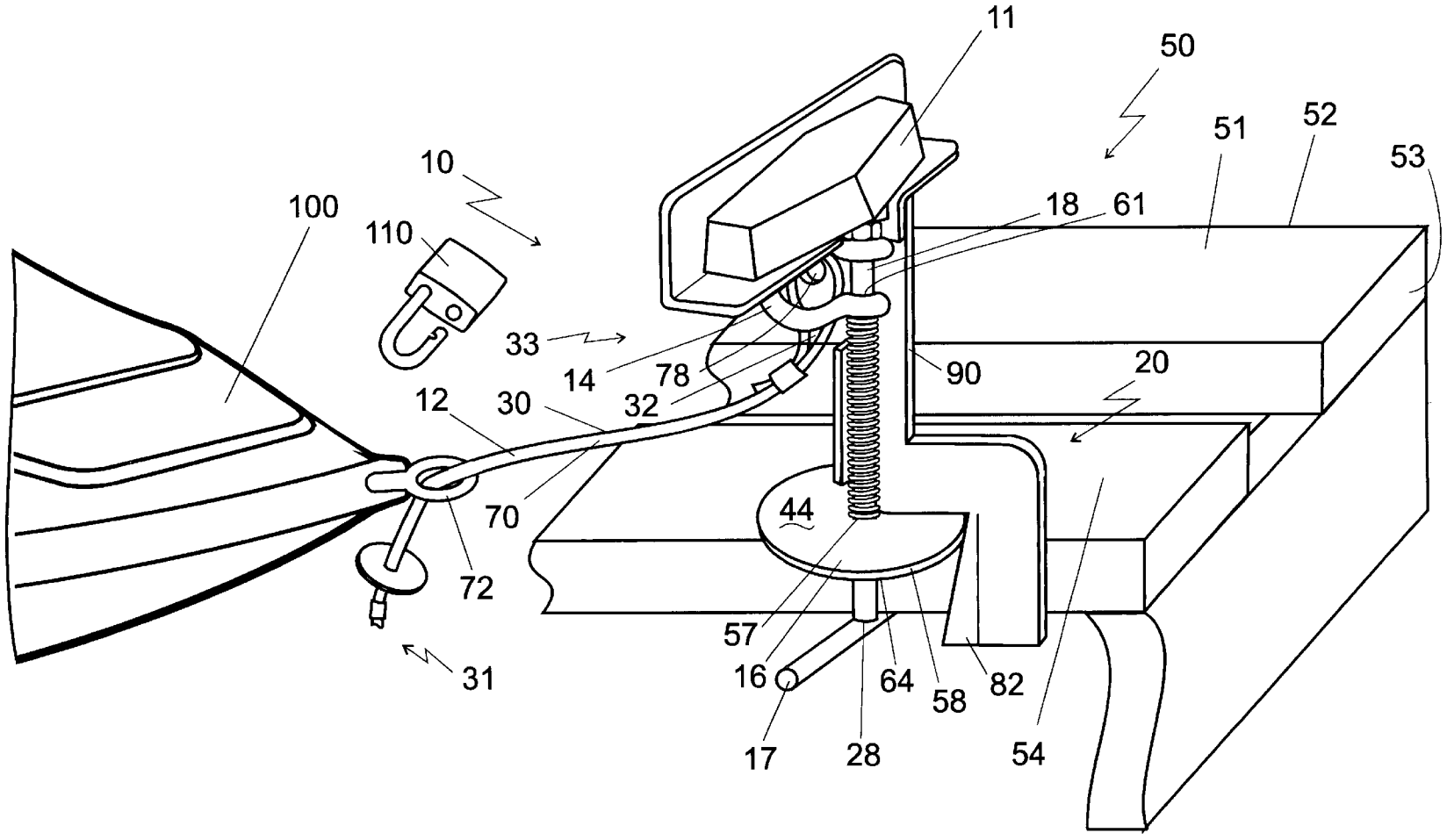
FIG. 1 is a perspective view of a portion of a dock with the preferred embodiment of the locking means of this invention engaged with a mooring device and having a closed end of a cable from a watercraft secured thereto.

Referring now to FIG. 1, a watercraft 100 is moored to a dock 50 utilizing the mooring device 10 and locking means 20 of this invention. A portion of mooring device 10 is adapted to be placed between adjacent dock boards 54 of the deck 51, vertical side walls 52 or end 53 of dock 50. Mooring device 10 may be utilized by a watercraft owner wherein a lanyard 30 having an eye 32 in the free end 33 thereof is attached to an anchor shackle clevis 14 and a locking means 20, associated with mooring device 10, with a padlock passed through eye 32, padlock hole 78 in locking means 20 and clevis 14. End 31 of lanyard 30 may be permanently affixed to watercraft 100 or may have an enlarged portion slidably disposed on lanyard 30 adapted to bear against one side of a towing eye 72 on watercraft 100 after free end 33 of lanyard 30 is passed through towing eye 72. An exact location of either mooring device 10 or watercraft 100 is no longer necessary as mooring device 10 may be placed between any two adjacent dock boards 54 and secured thereto with locking means 20 as is readily apparent from FIG. 1. Similarly, a dock owner may employ at least one mooring device 10 for each watercraft 100 desiring mooring to the owner's dock by placing mooring device 10 and locking means 20 between any two adjacent dock boards 54 and locking eye 32 of lanyard 30 from the watercraft 100 desiring mooring to clevis 14 and locking means 20. In this manner, cleats (not shown) normally attached to docks 50 may be removed providing a smoother exposed surface 55 on deck 51 thereby removing a potential safety hazard from dock 50. Upon detaching a watercraft 100 from his dock 50, the dock owner may secure mooring devices 10 and locking means 20 in secure locations within the service bay thereby preventing the theft thereof. Normally, lanyard 30 will comprise a common twisted fiber mooring rope 12 which a watercraft owner or dock owner may use for temporarily mooring watercraft 100 to docks 50, however, lanyard 30 may also be a steel cable 70 or chain.

In the preferred embodiment shown in FIG. 1 through FIG. 4, the mooring device 10 having the locking means 20 of this invention comprises an upright pivot shaft 18 having a T-shaped handle 11 at one end 27 thereof an elongated head 17 at the other end 28 thereof and a clevis 14, a biasing spring 15 and a tension plate 16 disposed about shaft 18 intermediate ends 27 and 28. Elongated head 17 is rigidly affixed to other end 28 of shaft 18 and tension plate 16 is biased toward elongated head 17 by biasing spring 15. Biasing spring 15 bears against one arm 34 of clevis 14 while other arm 35 of clevis 14 bears against an hexagonal jam nut 13 contiguous with the underside 36 of T-shaped handle 11, jam nut 13 firmly affixing T-shaped handle 11 to one end 27 of shaft 18. To secure a watercraft 100 to dock 50, elongated head 17 is placed between two adjacent dock boards 54 and T-handle 11 of mooring device 10 is depressed engaging tension plate 16 against the exposed surface 55 of dock boards 54 and placing elongated head 17 in a position below the opposite surface 56 of dock boards 54. T-handle 11 is then rotated through an angular amount, usually about ninety degrees, sufficient to move elongated head 17 to a position approximately perpendicular to dock boards 54. Upon releasing T-handle 11, the upper surface 25 of elongated head 17 engages the opposite surface 56 of dock boards 54 with biasing spring 15 firmly pressing tension plate 16 against exposed surface 55. Upper surface 25 of elongated head 17 may have engaging spikes 26 projecting therefrom adapted to bite into opposite surface 56 of dock boards 54 to provide positive engagement thereby preventing rotational movement of elongated head 17. It is to be fully understood that dock boards 54 are generally of common two by four lumber construction having a thickness of one and one-half inches with a spacing between adjacent dock boards of three eighths of an inch as specified in standards established for watercraft docks.

T-handle 11 is a plastic or metallic handle used for compressing spring 15 engaging tension plate 16 against an exposed surface 55 of adjacent dock boards 54 and for turning elongated head 17 into position on opposite surface 56 of dock boards 54. T-handle 11 is threaded onto the terminal end 38 of threaded portion 37 of shaft 18 above hexagonal nut 13 which has been previously threaded onto threaded portion 37 of shaft 18. Hexagonal nut 13 acts as a jam nut, locking T-handle 11 onto shaft 18. Spaced from the underside 39 of nut 13 is an anchor shackle clevis 14 which may have lanyard 30 attached thereto. The lower end 43 of spring 15 bears against the upper surface 44 of tension plate 16.

Tension plate 16 is formed as a flat disc having a central hole 57 substantially equal in diameter to the diameter of shaft 18. Tension plate 16 may have an outer periphery 58 of any shape with the distance between opposite edges 59 substantially larger than distance between dock boards 54. In this preferred embodiment, tension plate 16 is generally circular having a distance of about two and three quarters inches between opposite edges 59 corresponding to the diameter of tension plate 16. Tension plate 16 may be purchased from local farm supply houses as an one eighth inch thick, 2.75 inch diameter washer with a 0.375 inch diameter through bore or may be manufactured from one eighth inch thick rolled plate.

Spring 15 is preferably formed from spring wire into an helical coil having an inside diameter substantially equal to outside diameter of shaft 18. Spring 15 preferably has machine ground square ends 43 and 45 for positive engagement with upper surface 44 of tension plate 16.

Anchor shackle clevis 14 is formed into a U-shape having parallel arms 34 and 35 wherein each arm 34, 35 has a hole 61 formed therein perpendicular to the respective parallel arm 34, 35. Hole 61 in each of parallel arms 34, 35 is substantially equal in diameter to outside diameter of shaft 18. Clevis 14 is disposed upon shaft 18 by passing shaft 18 through holes 61 in parallel arms 34, 35. Clevis 14 then bears against the upper end 45 of spring 15 and also bears against underside 39 of nut 13. Clevis 14 has both parallel arms 34, 35 disposed upon smooth outer periphery of shaft 18 Anchor shackle clevis 14 may be purchased from local farm supply houses or hardware stores.

Threaded portion 37 of shaft 18 extends from terminal end 38 of shaft 18 at least a distance equal to thickness of nut 13 and the internal threaded length of T-handle 11. Nut 13 is disposed upon shaft 18 to substantially the full length of threaded portion 37. Nut 13 is preferably a common three eighths standard hexagonal (⅜UNC18) nut having eighteen threads per inch.

T-handle 11 is formed from a suitable material and preferably is approximately three and one half inches in length with a breadth of one and six tenths inches. T-handle 11 is approximately three quarters inch in thickness with a blind internal threaded hole 63 disposed in the undersurface 36 thereof Blind hole 63 has a three eighths standard thread (⅜UNC18) corresponding to threaded portion of shaft 18. T-handle 11 may be machined, cast or drop forged from metallic material such as brass, bronze, aluminum, iron or steel. Preferably, however, T-handle 11 is molded of a rigid thermoplastic around an internally threaded metallic insert thereby constituting blind threaded hole 63. T-handle 11 is most preferably molded of a phenolic resin thermoplastic commonly used for handles but may also be molded of any one or a combination of polypropylene, polyethylene, polyamide, polyparabenzamide, fiberglas, polytetrafluoroethylene or the like. Additionally, the above thermoplastic material may contain reinforcing fibers such as fiberglass carbon fiber or steel wires. To complete the assembly of mooring device 10, T-handle 11 is threaded upon terminal end 38 of threaded portion 37 of shaft 18. Nut 13 is then tightened against underside 36 of T-handle 11 locking same upon shaft 18.

In the preferred embodiments of FIG. 1 through FIG. 4, a mooring device 10 for securing of watercraft 100 to a structure, such as a dock 50 having spaced apart planking such as dock boards 54, comprises a shaft 18, an elongated bar 17 mounted transverse to shaft 18 an end 28 thereof, a T-shaped handle 11 removably mounted on another end 27 of shaft 18, an anchor shackle clevis 14 and an enlarged plate 16 disposed on shaft 18. A biasing spring 15 encircling shaft 18 biases plate 16 toward bar 17. A locking means 20 is associated with mooring device 10 which is a substantially planar elongated crank shaped snubber 21 having a wedge shaped offset portion 91 on one end 92 thereof, a T-shaped handle support 93 on the upper end 23 thereof and a shaft support 95 disposed between the plate 16 and the T-handle 11 intermediate ends 98, 23. Offset portion 91 is adapted to be disposed between dock board planking 54 with an elbow 96 of bar 90 bearing against top surface 44 of plate 16 when locking means 20 is rotated in the direction of arrow 120 in the plane of bar 90 until offset portion 91 engages the underside 64 of plate 16. When rotated into full engagement with mooring device 10, shaft support 95 of locking means 20 then bears against shaft 18 and handle support 93 underlies T-shaped handle 11. A means for securing 22 is disposed in upper end 23 of snubber 21 and may be shaped to be parallel to and substantially the same size as clevis 14. As best observed in FIG. 4, means for securing 22 has a padlock hole 78 for receiving a padlock therein and is disposed between handle support 93 and shaft support 95 capturing clevis 14 therebetween when a padlock 110 is inserted through clevis 14, padlock hole 78 thereby securing locking means 20 to mooring device 10 and mooring device 10 to dock 50.

Locking means 20 may further have a handle engaging means 24 on upper end 23 of snubber 21 for engaging handle 11 and preventing rotation thereof. Handle engaging means 24 may be L-shaped engaging handle 11 on the underside 36 and at least one face 40 or handle engaging means 24 may be channel shaped engaging underside 36, one face 40 and top 41 of handle 11.

Locking means 20 has a plate engaging means 97 on the lower end 98 of snubber 21 for engaging plate 16 on the upper surface 44 thereof plate engaging means 97 preventing rotation of snubber 21 relative to plate 16 by frictional engagement therewith or by a cooperating means disposed on or in plate 16. Cooperating means may comprise a hole in plate 16 or may constitute a ridge or recess formed in plate 16 on at least one side of and spaced away from hole 57. Where cooperating means comprises a hole in plate 16, a projection (not shown) is provided on lower end 98 of snubber 21 which projects into the hole.

Locking means 20 may further have a horizontal portion 99 appended to plate engaging means 97 extending beyond edge 59 of outer periphery 58 of plate 16 with a vertical portion 62 at the terminal end thereof engaging edge 59 of plate 16. Vertical portion 62 extends downwardly between decking elements 54 below plate 16 and has a wedge shaped portion 82 protruding under plate 16 which engages the underside bottom surface 64 of plate 16 at least at the juncture 83 of the bottom surface 64 and edge 59 of plate 16 thereby preventing rotation of snubber 21 relative to docking platform 50. Snubber 21, means for securing 22, plate engaging means 97, horizontal portion 99, vertical portion 62 and wedge shaped portion 82 are co-planar but wedge shaped portion 82 may be offset relative to the plane of these other elements creating offset portion 91. Wedge shaped portion 82 of vertical portion 62 extending downwardly between decking elements 54 below plate 16 extends below opposite surface 56 of decking elements 54 preventing rotation of elongated head 17 into the slot 29 between the decking elements 54. Means for securing 22 extends from one edge 88 of snubber 21 and horizontal portion 99 extends from an edge 89 opposite one edge 88.

Snubber 21 of locking means 20 may have a shaft support 95 extending at a right angle therefrom intermediate plate 16 and T-handle 11. When engaged with shaft 18 of mooring device 10, snubber 21 and shaft support 95 are both parallel to and adjacent shaft 18 capturing shaft 18 in at least the plane of snubber 21 and a plane normal thereto. Shaft support 95 may be channel shaped thereby capturing shaft 18 between snubber 21, a plane parallel to snubber 21 and a plane normal thereto. Therefore, when padlock 110 is inserted into padlock hole 78 in locking means 20, through clevis 14 of mooring device 10 and eye 32 of lanyard 30, mooring device 10 and locking means 20 function as one unit securely mooring a watercraft 100 to a dock 50.

Snubber 21 usually has an L-shaped handle engaging means 24 on upper end 23 thereof which is L-shaped and engages handle 11 on underside 36 and at least one face 40. Handle engaging means 24 is upright and disposed at a right angle to the plane of snubber 21. Handle engaging means 24 may be channel shaped engaging handle 11 on underside 36, one face 40 and top 41 thereby capturing handle 11 in two planes normal to upper end 23 spaced apart by at least the height of handle 11 and a plane normal to these two planes.

Handle engaging means 24 usually extends on either side 84, 85 of snubber 21 and supports handle 11 for the full length thereof and has a central portion 86 removed from the horizontal leg 87 thereof for capture of jam nut 13 of mooring device 10 therein.

Figure 6:
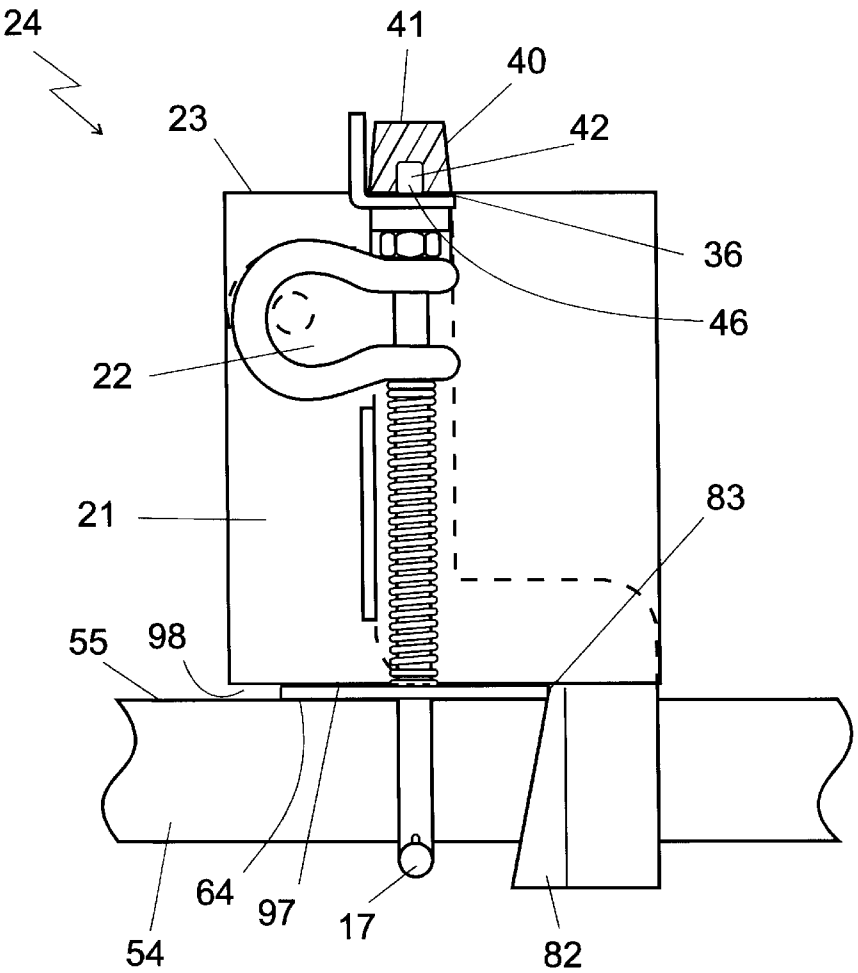
FIG. 6 is an alternate embodiment of a snubber of the locking means of this invention.

A method of manufacturing a locking device 20 for a mooring device 10 comprises a first step of forming a snubber 21 from a flat plate of metal, forming a plate engaging means 97 on lower end 98, forming a handle engaging means 24 on upper end 23 and forming means for securing 22 adjacent upper end 23. As best shown in FIG. 6, snubber 21 may be rectangular having a peg 42 formed on upper end 23 adapted to be engaged in a recess 46 formed in the underside 36 of handle 11 and having padlock hole 78 formed in snubber 21 adapted for alignment with anchor clevis 14. Plate engaging means 97 is formed as a square edge on lower end 98 of snubber 21. When snubber 21 of FIG. 6 is utilized with mooring device 10, peg 42 is first engaged with recess 46, thereafter snubber 21 is rotated toward shaft 18 with plate engaging means sliding along upper surface 44 of plate 16 in a direction normal to the plane of snubber 21 until snubber 21 is adjacent shaft 18. Anchor clevis 14 is then rotated about shaft 18 until padlock hole 78 is aligned with anchor clevis 14 and padlock 110 is affixed thereto. It is readily apparent therefore, when snubber 21 of FIG. 6 is secured to clevis 14 with padlock 110 wherein peg 42 is engaged in recess 46, it is impossible to dislodge snubber 21 from a position adjacent shaft 18.

Figure 2:
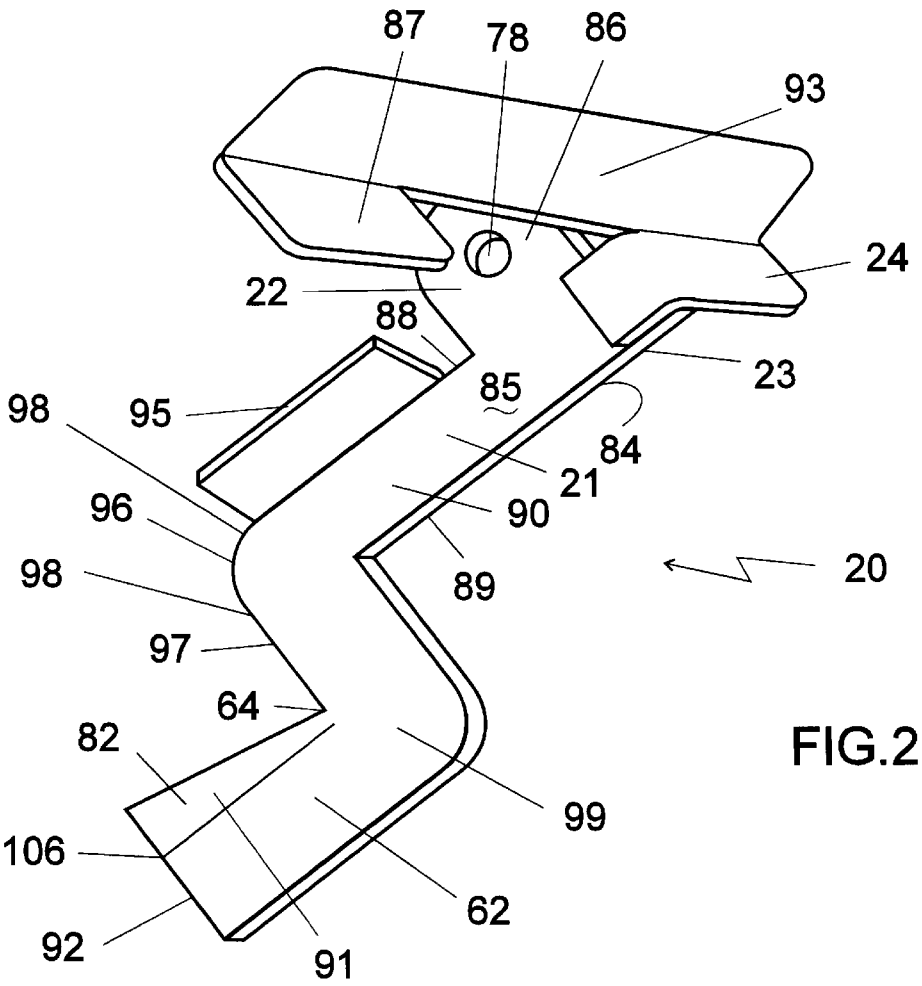
FIG. 2 is a perspective view of the preferred embodiment of the locking means of this invention.
Figure 5:
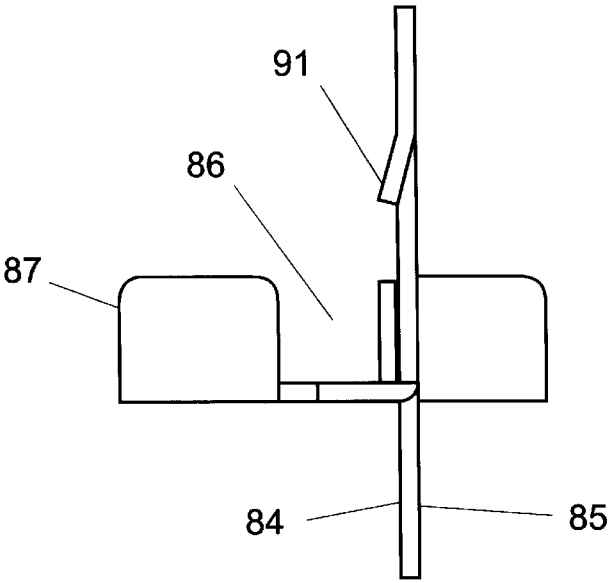
FIG. 5 is an bottom view of the preferred embodiment of the locking means of this invention showing the angle of the offset portion.

In the preferred embodiment shown in FIG. 2 through FIG. 5, snubber 21 is crank shaped having vertical portion 62 formed as a handle, horizontal portion 99 formed as the crank arm and planar bar 90 formed as the crank extension. An offset portion 91, as best observed in FIG. 2 and FIG. 5, is formed on one end 92 of vertical portion 62, offset 91 being first formed as wedge shaped portion 82 and thereafter offset through an angle of at least five degrees (5°) relative to the plane of vertical portion 62 along crease 106. Vertical portion 62 is formed perpendicular to and upon end 94 of horizontal portion 99 which extends from edge 89 of snubber 21. Horizontal portion 99 is perpendicular to planar bar 90 and has elbow 96 formed at the juncture thereof and plate engaging means 97 formed on the lower end 98 thereof Elbow 96 is a radius joining edge 88 and plate engaging means 97 and provides means for rotation of locking means upon plate 16 when engaging locking means 20 with mooring device 10. Plate engaging means 97 is a flat square surface on lower end 98 of planar bar 90 and horizontal portion 99.

Locking means 20 is completed by forming a handle engaging means 24 on the upper end 23 of planar bar 90, forming a means for securing 22 adjacent upper end 23 extending from an edge 88 of snubber 21 and forming a shaft support 95 at a right angle to snubber 21 intermediate handle engaging means 24 and plate engaging means 97. Handle engaging means 24 is separately formed as an "L" shaped elongated handle support having a central portion 86 removed from the horizontal leg 87 thereof. Central portion 86 is adapted to receive nut 13 and a portion of T-handle 11 therein when locking means 20 is fully engaged with mooring device 10. Central portion 86 is generally cut through horizontal leg 87 and bent downwardly perpendicular thereto for securing handle engaging means 24 to planar bar 90 of snubber 21. Handle engaging means 24 may alternately be channel shaped having two horizontal portions spaced apart by at least the height of handle 11. Central portion 86 is cut through and bent downwardly in a similar manner for attaching channel shaped handle engaging means 24 to snubber 21. Handle engaging means 24 is affixed to either side 84, 85 of upper end 23 of planar bar 90 by welding, brazing or threaded fasteners.

Shaft support 95 may also separately be formed as an "L" shaped or channel shaped member having a leg 101 at least as wide as the diameter of spring 15 upon shaft 18. Shaft support 95 may be any length less than the distance between securing means 22 and plate engaging means 97. Shaft support 95 is secured to edge 88 of planar bar 90 and is disposed between elbow 96 and securing means 22. Typically, shaft support 95 is formed as an angle bent along edge 88 of planar bar 90 to a position perpendicular to planar bar 90. When separately formed, shaft support 95 is affixed to edge 88 or to either side 84, 85 of planar bar 90 by welding, brazing or threaded fasteners.

Means for securing 22 is formed onto edge 88 and projects therefrom in the plane of snubber 21 at upper end 23 of planar bar 90 of snubber 21 and is parallel to and substantially the same size as clevis 14. Padlock hole 78 is formed through means for securing 22 and adapted for receiving padlock 110 therein.

Snubber 21 may be flame cut, sawn, laser cut or stamped from cold rolled or hot rolled steel plate approximately one eighth inch (⅛") thick. Using plate engaging means 97 as a reference surface, vertical portion 62 is formed as the handle of the crank approximately one and seven eighths inches (1⅞") in length and approximately one and one half inches (1½") wide at end 92 and approximately one inch (1") wide at plate engaging means 97. Wedge shaped portion 82 is thus formed along an crease 106 in vertical portion 62. Offset portion 91 comprises wedge shaped portion 82 and is offset along crease 106 approximately 15° from the plane of vertical portion 62. Horizontal portion 99 is approximately one inch (1") wide from plate engaging means 97 to outer edge 102 and is approximately one and one quarter inches (1¼") in length from edge 89 to end 94. Plate engaging means 97 is square cut to sides 84, 85 of horizontal portion of snubber 21. Planar bar 90 is approximately three quarters of an inch (1") in width and approximately four and one half inches (4½") in length from upper end 23 to plate engaging means 97. Securing means 22 is approximately one and one quarter inch (1¼") in width and projects from edge 88 of planar bar 90 approximately one and three eighths inch (1⅜"). Means for securing 22 has a one quarter inch diameter padlock hole 78 flame cut, drilled or punched through snubber 21 approximately one and one sixteenth inch (1 1/16") below upper end 23 and approximately one and three quarters inch (1¾") from edge 89. Thus padlock hole 78 is substantially aligned with the curve of clevis 14 such that padlock may be passed through padlock hole 78 and clevis 14 and secured thereto, thereby preventing removal of mooring device 10 from a docking platform. Shaft support 95 is approximately two inches (2") in length, five eighths inch (⅝") in width and is spaced from upper end 23 approximately two inches (2"). Shaft support 95 may also be channel shaped by extending support 95 in width a sufficient amount and forming an angle at five eighths inch (⅝") from surface 85 of planar bar creating an outer plate (not shown) parallel to surface 85 thus enclosing shaft 18 upon three sides when locking means 20 is rotated into position and fully engaged with mooring device 10.

Handle engaging means 24 is initially separate from locking means 20 and is a seven eighths inch (⅞") angle or channel approximately three inches in overall length. A cut is made through horizontal leg 87 approximately one and one quarter inch (1¼") from one end and along vertical leg 103 away from the one end approximately three quarters inch (¾") in length. The affixing tab 105 thus formed is bent downwardly away from and perpendicular to horizontal leg 87 forming central portion 86 in horizontal leg 87. Handle engaging means 24 is then affixed to either side 84, 85 of upper end 23 by welding, brazing or threaded fasteners through suitable threaded holes.

Figure 3:
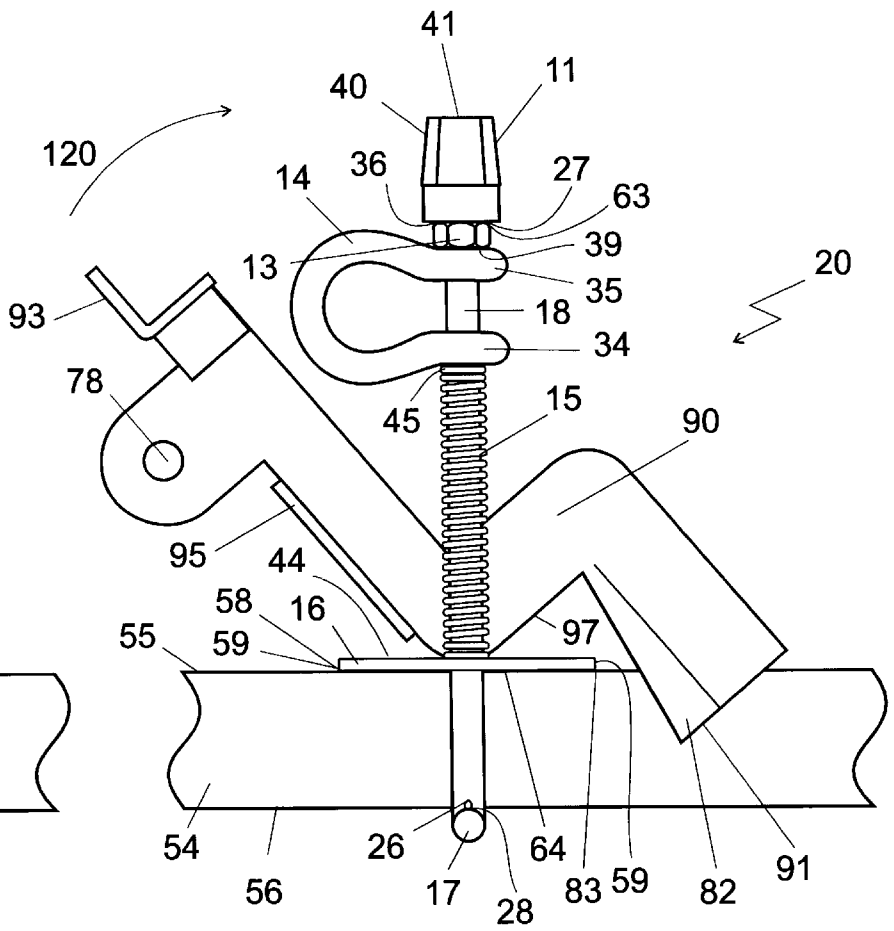
FIG. 3 is a side elevation of the preferred embodiment of the locking means initially engaged with a plate of the mooring device.
Figure 4:
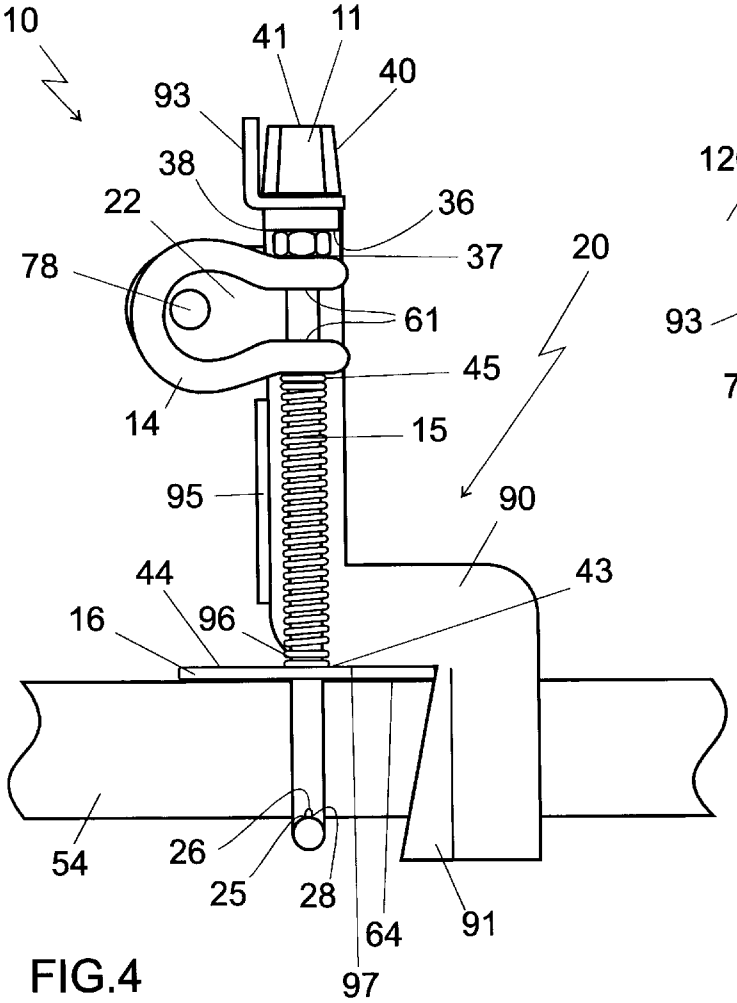
FIG. 4 is a side elevation of the preferred embodiment of the locking means fully engaged with of the mooring device.

When it is desired to secure a watercraft 100 to a docking platform using the preferred embodiment of the locking means 20 shown in FIG. 2, mooring device 10 is placed between adjacent docking boards 54 and engaged therewith by pressing handle 11 toward plate 16, moving elongated head 17 in a position below dock boards 54, rotating handle 11, and hence elongated head 17, through an angle of approximately 90 degrees and thereafter removing the downward pressure from handle 11. Engaging spikes of elongated head 17 engage opposite surface 56 of dock boards 54 while plate 16 lies upon upper surface thereof. As shown in FIG. 3, locking means 20 is placed at an angle along side shaft 18 with elbow 96 resting upon upper surface 44 of plate 16 with a portion of vertical portion 62 lying between adjacent docking boards 54. Locking means 20 is then rotated in the direction of arrow 120 moving handle support 24 toward handle 11. As handle support 24 engages the underside 36 of handle 11, shaft support 95 moves into position adjacent to shaft 18 and plate engaging means 97 becomes contiguous with upper surface 44 of plate 16. Likewise, vertical portion 62 moves downwardly between docking boards 54 and wedge shaped portion 82 and offset 91 engage edge 59 of plate 16 at least at juncture 83 of underside 64 and edge 59. When all elements are fully engaged with the respective positions as described above and shown in FIG. 4, clevis 14 may be rotated about shaft 18 into position adjacent means for securing 22 and eye 32 of lanyard 30 may be placed between clevis 14 and means for securing 22. When padlock 110 is inserted through padlock hole 78, clevis 14, eye 32 and closed in a locked position, mooring device 10 is securely locked to docking platform 50 and hence, a secure mooring of a watercraft 100 is accomplished.

In the alternate embodiment in FIG. 6, the features of the preferred embodiment may be formed on snubber 21 with vertical portion formed upon an outer end of plate engaging means 97 extending beyond plate 16 as shown having wedge shaped portion 82 and offset 91 formed thereon as shown by the dashed lines extending downwardly from plate engaging surface 97. Furthermore, handle engaging means 24 may be formed upon upper end 23 as shown by the dashed lines thereabove in FIG. 6. Finally, shaft support 95 may be formed upon snubber 21 adjacent the location of shaft 18 as shown by the dashed line. It is readily apparent that in order to utilize all of the features of the preferred embodiment with the enlarged snubber 21 of FIG. 6, vertical portion must be on the same edge of the plane as securing means 22.

When utilizing the alternate embodiment of FIG. 6 for mooring a watercraft 100 to a dock 50, elongated head 17 of mooring device 10 is placed in slot 29 between adjacent dock boards 54 with plate 16 spanning across slot 29 and engaging the upper surface 55 thereof Handle 11 is pressed downwardly toward plate 16 moving elongated head 17 below opposite surface 56 of dock boards 54. While depressed, handle 11 is rotated through an angle of approximately 90 degrees moving elongated head 17 in a position perpendicular to the direction of dock boards 54. Pressure is released from handle 11 and engaging spikes 26 engage opposite surface 56 while plate engages upper surface 55 with spring 15 providing a biasing force between elongated head 17 and underside 64 of plate 16. Snubber 21 of FIG. 6 is then moved along the upper surface 44 of plate 16 into engagement with handle 11, shaft 18 and edge 59 of plate 16 where vertical portion 62 is utilized with snubber 21. Anchor clevis 14 is rotated into position adjacent securing means 22 and padlock 110 is inserted through padlock hole 78, eye 32 of lanyard 30 and clevis 14. Padlock 110 is then locked securing lanyard 30 and securing means 22 clevis 14 of mooring device 10. Plate 16 may have at least one slot formed in upper surface 44 or at least one raised portion formed thereon spaced from shaft 18 by the thickness of snubber 21 which captures plate engaging surface 97 therein or therealong, thereby preventing snubber 21 from being rotated in a direction normal to the plane thereof. Of course, it is understood that clevis 14 may be disposed at a location just above plate 16 by spacing clevis 14 thereabove and therefore securing means 22 is similarly situated closer to plate engaging means 97 having padlock hole 78 also spaced thereabove.

It is readily apparent from a reading of this description and viewing of the drawings that the integrity of a mooring utilizing any one of locking means 20 of this invention with mooring device 10 may not be breached when padlock 110 locks clevis 14 to locking means 20 as handle engaging means 24 firmly engages handle 11 and plate engaging means firmly engages plate 16 thereby allowing snubber 21 to prevent handle 11 from being moved toward plate 16.

While the forms and methods of this invention now preferred have been illustrated and described as required by the Patent Statute, it is to be understood that other forms and methods can be utilized and still fall within the scope of the appended claims.

I claim:

1. In a mooring device having a locking means associated therewith, the mooring device having an anchor shackle clevis for securing a line thereto and comprising a body in rigid T-bar form having a shaft, an elongated head secured transversely to one end of the shaft and a T-shaped handle secured to the opposite end thereof, wherein the head is sufficiently narrow to fit between the decking elements of a mooring platform, the shaft further having a flat plate mounted thereon for slideable movement toward and away from the head with a biasing means associated with the plate to urge the head toward the plate, the improvement wherein said locking means comprises a snubber disposed between the plate and the T-handle, said snubber having means for securing to the clevis thereby preventing removal of the mooring device from the mooring platform.

2. A locking means as described in claim 1 wherein said means for securing projects from an upper end of said snubber parallel to and substantially the same size as the clevis and has a padlock means for receiving a padlock therein.

3. A locking means as described in claim 1 wherein said snubber has a handle engaging means on the upper end thereof for engaging the handle and preventing rotation thereof.

4. A locking means as described in claim 3 wherein said handle engaging means on the upper end of said snubber is L-shaped and engages the handle on the underside and at least one face.

5. A locking means as described in claim 4 wherein said L-shaped handle engaging means is upright and disposed at a right angle to the plane of said snubber.

6. A locking means as described in claim 5 wherein said handle engaging means extends on either side of said snubber and supports the handle for the full length thereof.

7. A locking means as described in claim 4 wherein said L-shaped handle engaging means has a central portion removed from the horizontal leg thereof for capture of a jam nut securing said T-shaped handle to said one end of said shaft of the mooring device therein.

8. A locking means as described in claim 1 wherein said snubber has a plate engaging means on the lower end thereof for engaging the plate on the upper surface thereof, said plate engaging means preventing rotation of said snubber relative to the plate.

9. A locking means as described in claim 8 wherein said plate engaging means has a horizontal portion extending beyond an edge of the plate.

10. A locking means as described in claim 9 wherein said horizontal portion extending beyond the edge of the plate has a vertical portion at the terminal end thereof engaging the edge of the plate.

11. A locking means as described in claim 10 wherein said vertical portion extends downwardly between the decking elements below the plate thereby preventing rotation of said snubber relative to the docking platform.

12. A locking means as described in claim 11 wherein said vertical portion extending downwardly between the decking elements below the plate has a wedge shaped portion protruding under the plate and engages the bottom surface of the plate at least at the juncture of the bottom surface and the edge of the plate.

13. A locking means as described in claim 12 wherein said snubber, means for securing, plate engaging means, horizontal portion, said vertical portion and said wedge shaped portion are co-planar.

14. A locking means as described in claim 12 wherein said wedge shaped portion is offset relative to the plane of said vertical portion.

15. A locking means as described in claim 12 wherein said wedge shaped portion of said vertical portion extending downwardly between the decking elements below the plate extends below a bottom surface of the decking elements preventing rotation of the T-bar into the slot between the decking elements.

16. A locking means as described in claim 9 wherein said means for securing extends from one edge of the plane of said snubber and said horizontal portion extends from an edge opposite said one edge.

17. A locking means as described in claim 1 wherein said snubber has a shaft support extending at a right angle therefrom intermediate the plate and the T-handle, wherein said snubber and said support are parallel to and adjacent to the shaft of the mooring device when engaged therewith.

18. A locking means as described in claim 11 wherein said means for securing is substantially the same size as the clevis, has a padlock means for receiving a padlock therein and is disposed between said T-handle support and said vertical support capturing the clevis therebetween when a padlock is inserted in said padlock means.

19. In a mooring device for securing of watercraft to a structure having spaced apart planking, the mooring device comprising a shaft, an elongated bar mounted transverse to the shaft on one end thereof, a T-shaped handle removably mounted on the other end of the shaft, a mooring shackle and an enlarged plate disposed on the shaft, a biasing spring encircling the shaft and adapted to bias the plate toward the bar, the device having locking means associated therewith, the improvement wherein said locking means is a substantially planar elongated crank shaped bar having a wedge shaped offset portion on one end thereof, a T-shaped handle support on the other end thereof and a shaft support intermediate said ends, said wedge shaped offset portion adapted to be disposed between the planking with an elbow of said crank shaped bar bearing against the top surface of the plate, said locking means rotated in the plane of said crank shaped bar until said wedge shaped offset portion engages the underside of the plate, said shaft support on said crank shaped bar bears against the shaft and said handle support underlies the T-shaped handle wherein a padlock is inserted through said shackle and a padlock hole in said crank shaped bar securing said crank shaped bar to the mooring device.

20. A method of manufacturing a locking device for a mooring device comprises the steps of forming a snubber in a crank shape from a flat plate of metal, forming a wedge shaped offset portion on one end thereof extending from one edge of said snubber, forming a handle engaging means on the other end thereof, forming a means for securing adjacent said other end and extending from one edge of said snubber and forming a shaft support at a right angle to said snubber intermediate said handle engaging means and said wedge shaped offset portion.

* * * * *